US005851122A

United States Patent [19]

Huber et al.

[11] Patent Number: 5,851,122

[45] Date of Patent: Dec. 22, 1998

[54] MULTIPOLE, PLASTIC CONNECTOR HOUSING

[75] Inventors: Elmar Huber, Pfullingen; Peter-Rene Koch, Wannweil; Wolfgang Woernle, Gomaringen, all of Germany

[73] Assignee: Robert Bosch GmbH, Stuttgart, Germany

[21] Appl. No.: 684,028

[22] Filed: Jul. 19, 1996

[30] Foreign Application Priority Data

Aug. 30, 1995 [DE] Germany ..... 2 95 13876.9

[51] Int. Cl.[6] ..... H01R 13/66

[52] U.S. Cl. ..... 439/620; 439/701

[58] Field of Search ..... 439/620, 736, 439/606, 686, 695, 701

[56] References Cited

U.S. PATENT DOCUMENTS 4,884,980 12/1989 Bensing et al. ..... 439/695
5,213,522 5/1993 Kojima ..... 439/620
5,213,524 5/1993 Okamoto et al. ..... 439/620
5,224,878 7/1993 Lurie et al. ..... 439/620
5,282,753 2/1994 Su ..... 439/695

FOREIGN PATENT DOCUMENTS 41 14 921 11/1992 Germany .

*Primary Examiner*—Gary F. Paumen
*Attorney, Agent, or Firm*—Kenyon & Kenyon

[57] ABSTRACT

In a multipole plastic connector housing, the capacitors used for interference-suppression are arranged so positionally secured that they do not change their position when the connector housing is injection molded. The capacitors are electroconductively connected to contact insertion parts, and the capacitors and the contact insertion parts are inserted as preassembled parts into a clip part, which is inserted into an injection mold and is subsequently embedded at the same time when the connector housing is injection molded. The connector housing is intended for use in a transistor ignition system for motor vehicles.

3 Claims, 2 Drawing Sheets

MULTIPOLE, PLASTIC CONNECTOR HOUSING

BACKGROUND INFORMATION

German Patent No. 41 14 921 C2 describes a connector, in the housing of which a printed-circuit board is arranged. The housing of the connector is comprised of two C-shaped housing halves, so that a cross-section reveals a rectangular housing. Disposed in the front area of the connector is a connector block, in which eight plug pins are provided. To protect the plug pins, they are overlapped by an extension of the connector housing. The plug pins are connected to electronic components, which are arranged on the printed-circuit board. All the parts of the known connector are inserted in a premolded plastic housing of the connector, and thus, they are not embedded by injection molding.

It is also known, when injection-molding a connector housing, to embed individual parts of a connector along with the connector housing; however, there is always the danger that the parts to be embedded will shift.

SUMMARY OF THE INVENTION

An object of the present invention is to avoid this disadvantage and to create a multipole plastic connector housing in which the insertion parts to be embedded by injection molding are securely fixed in position. Moreover, the present invention makes it possible to have a very inexpensive and uncomplicated assembly of the individual parts.

Thus, it is advantageous, for example, for the capacitors to be welded to the insertion parts prior to the injection molding to achieve a secure connection of the two parts.

DETAILED DESCRIPTION

Figure 1:
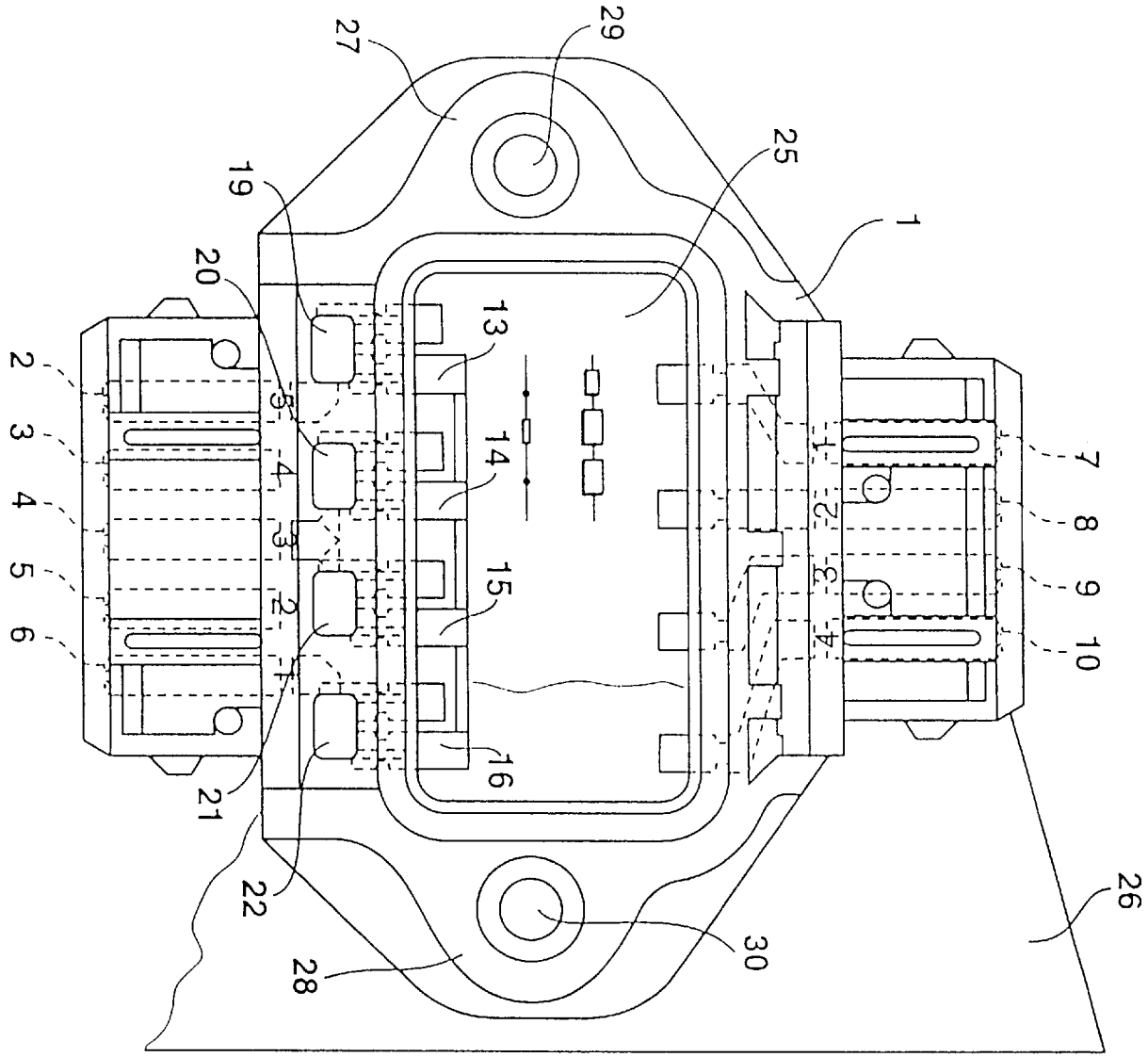
FIG. 1 shows a top view of the housing according to the present invention.

A connector housing 1 is made by an injection moldable plastic and is provided on its one side (bottom of the drawing) with five connections and, on its other side (top of the drawing) with four connections. These connections are also referred to as poles. The middle, bottom connection is a ground connection. All of the connections are designed as connector blades 2 through 10 and are protectively overlapped by extensions 11 and 12 of the connector housing 1. Each connector blade 2, 3, 5 and 6, except for the connector blade 4 of the bottom connection provided for the ground connection, is designed as the end of a contact insertion part 13, 14, 15, 16, the configuration of one of them being easily discernible in the side view shown in FIG. 2.

Figure 2:
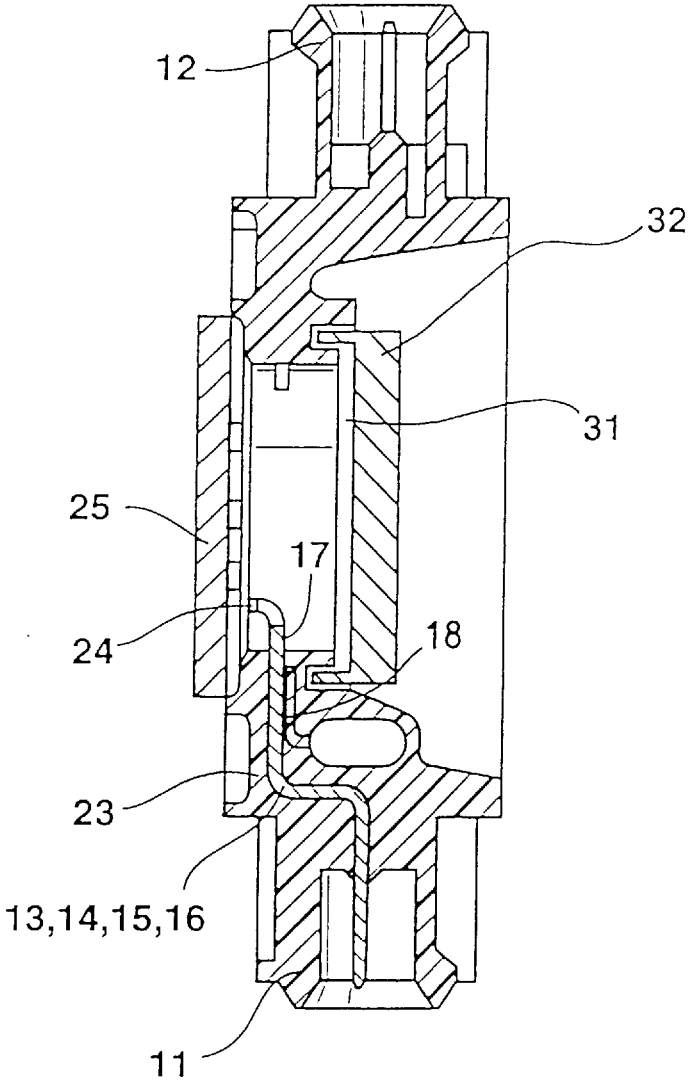
FIG. 2 shows a cross-section of the housing in a side view.

At the same time, FIG. 2 shows that each contact insertion part 13, 14, 15 or 16 is set off with a stepped formation and, on its first step 17, is electroconductively connected to a connection 18 of an interference-suppression capacitor 19, 20, 21 or 22, this connection preferably being made by means of a resistance welding or by soldering or casting. The thus created four connections of one contact insertion part 13, 14, 15 or 16 and one capacitor 19, 20, 21 or 22 are then inserted in an elongated, case-type clip part 23 made of plastic.

On its outer surface area, the clip part 23 has several small fastenings (horizontal members) which grip ribs from behind that are provided in an injection mold 26 whose cavity has the contours of the connector housing 1, in order to fix the clip part in position in the injection mold 26.. However, the fastening and the ribs are not shown. An offset 24 of each contact insertion part 13, 14, 15 or 16 represents an electrical connection of the contact insertion parts 13, 14, 15, 16 among themselves. A base plate bears the reference numeral 25.

If the clip part 23 with the four capacitors 19, 20, 21 and 22 and the four contact insertion parts 13, 14, 15 and 16 are localized in the injection mold 26, plastic material can be injected into the mold 26. In so doing, the clip part 23 that likewise includes plastic is embedded into the material of the plastic connector housing 1.

After the plastic material solidifies, the finished plastic connector housing 1 is then removed from the injection mold 26. By way of the formed mounting ears 27 and 28, as well as a circumferential adhesive surface, the connector housing 1 is then secured to the base plate 25 using two screw connections 29 and 30. A still free opening 31 of the connector housing 1 is then sealed by a rectangular cover 32.

What is claimed is:

1. A plastic multipole connector housing made by an injection molding operation using an injection mold, the housing comprising:

a clip part;

a plurality of contact insertion parts; and a plurality of capacitors, each of the plurality of capacitors being connected to a respective one of the plurality of contact insertion parts and being secured in the clip part;

wherein the clip part, the contact insertion parts and the capacitors are together arranged in the injection mold and are together embedded with plastic of the connector housing.

2. The connector housing according to claim 1, wherein each of the plurality of capacitors is resistance welded to the respective one of the plurality of contact insertion parts.

3. The connector housing according to claim 1, further comprising:

a first side having a four-pole design; and a second side having a five-pole design.

* * * * *